United States Patent [19]

Knudsen

[11] Patent Number: 4,490,963

[45] Date of Patent: Jan. 1, 1985

[54] PACKAGING MACHINE

[76] Inventor: David S. Knudsen, 3145 Hawthorne Blvd., St. Louis, Mo. 63104

[21] Appl. No.: 321,694

[22] Filed: Nov. 16, 1981

[51] Int. Cl.[3] ..... B65B 5/02; B65B 61/26

[52] U.S. Cl. ..... 53/559; 53/131; 53/453

[58] Field of Search ..... 53/559, 453, 131

[56] References Cited

U.S. PATENT DOCUMENTS

| | | | |
|---|---|---|---|
| 3,035,382 | 5/1962 | Lemelson | 53/559 |
| 4,012,888 | 3/1977 | Nichols | 53/559 X |
| 4,068,448 | 1/1978 | Modeen | 53/559 X |
| 4,366,663 | 1/1983 | Grebe | 53/559 |

*Primary Examiner*—A. J. Heinz

*Attorney, Agent, or Firm*—Gravely, Lieder & Woodruff

[57] ABSTRACT

A machine for packaging small objects such as medicinal pills, tablets or capsules has a path along which a carrying strip extends, passing through various stations as it does. At the first station information is printed on the strip. At the next side-by-side pockets are formed in the strip. Then comes a loading station where the pocketed carrying strip passes over a track located between two trays over which are spread the small objects that are to be loaded in pockets. Here the strip also passes beneath a divider rail that extends longitudinally of the strip between the two rows of pockets in the strip to separate those pockets so that the small objects on the trays are easily manipulated into the pockets. The divider rail also keeps the carrying strip from lifting off of the track. Following the loading station a covering strip is directed over the carrying strip, and the covering strip is heat sealed to the carrying strip around the pockets in the covering strip at a sealing station. Immediately after the sealing station is a drive station where the joined together carrying and covering strips pass into a nip formed by rollers which rotate incrementally to advance the strips. The rollers also perforate the strips between the two rows of pockets. Finally, there is a cutting station where the joined together strips are severed transversely between successive pairs of pockets.

20 Claims, 12 Drawing Figures

FIG. 1
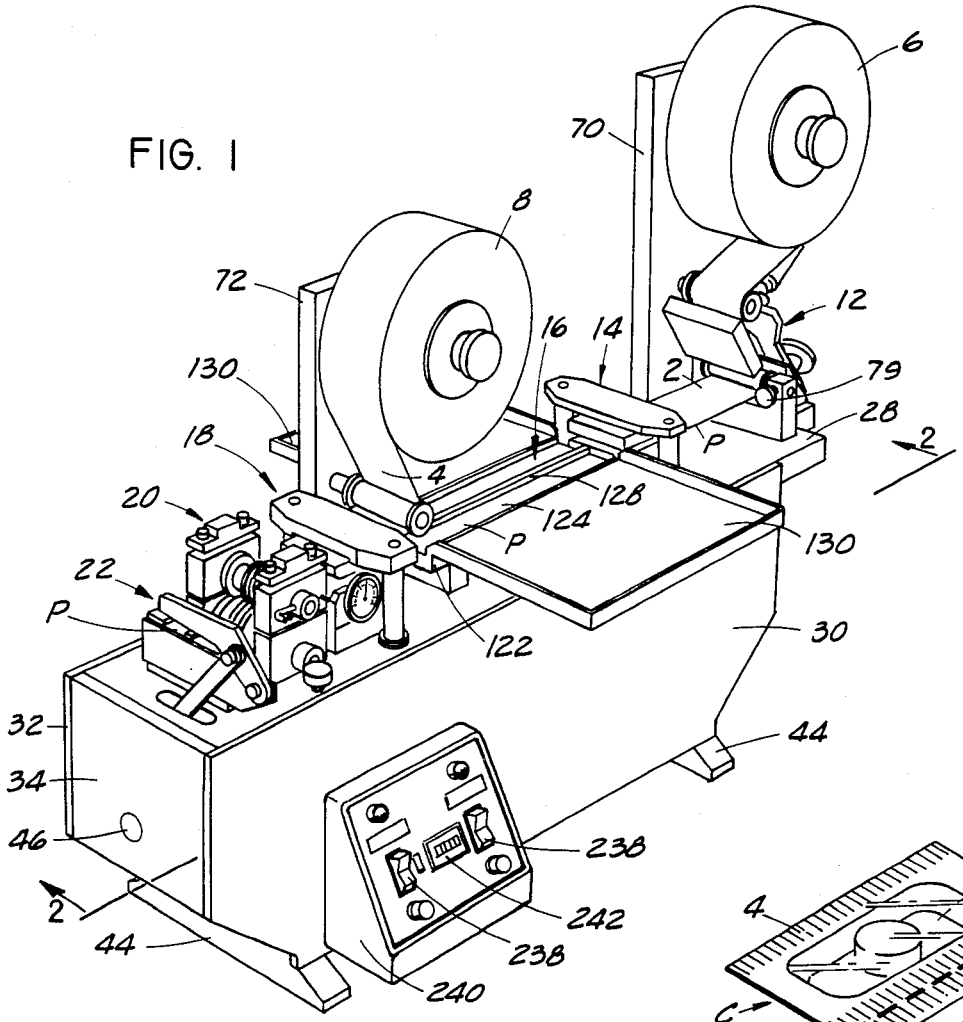
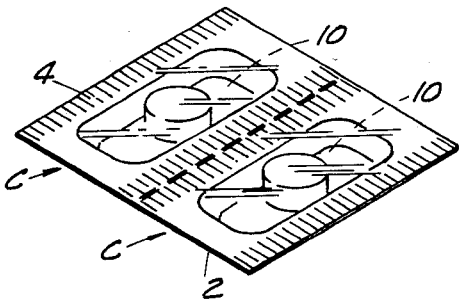
FIG. 12
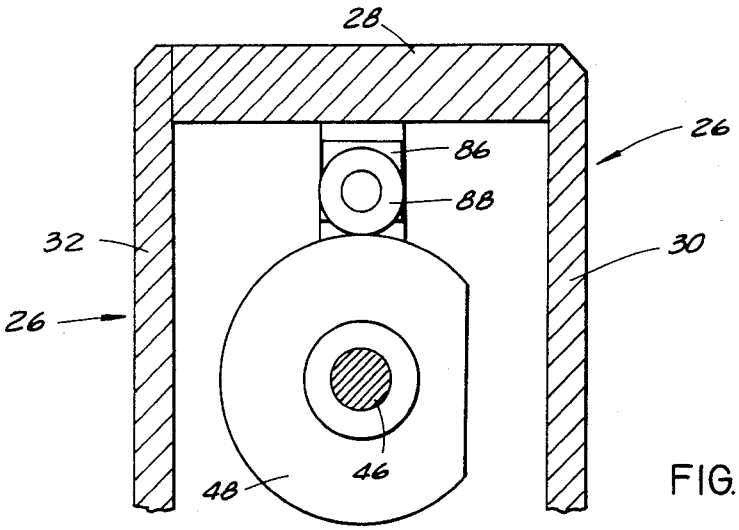
FIG. 3

PACKAGING MACHINE

BACKGROUND OF THE INVENTION

This invention relates in general to packaging, and more particularly to a machine for packaging small solid objects such as medicines that are in the form of pills, tablets, and capsules.

Hospitals and nursing homes administer large quantities of medicines in the form of pills, tablets, and capsules to their patients, and as a consequence find it economical to purchase such medicines in bulk quantities. Indeed, most hospitals maintain their own pharmacies for purchasing the medicines and distributing them to their patients.

Some hospitals and nursing homes merely place each patient's medicine in a small cup which is delivered to the patient's room. This is not entirely satisfactory because of the danger of contamination and of confusing the medicines of different pateints. The more desirable approach is to seal the pills, tablets, and capsules in packages, each bearing the name of the particular medicine that is within the package. Since the package is not opened until it reaches the patient's bedside, the chance of contamination is reduced significantly. Also, by reason of the fact that the packages are individually marked, one can compare a patient's medicine with the patient's prescription immediately before the medicine is administered, and this greatly reduces the chance of the patient receiving the wrong medicine.

Machines currently exist for individually packaging pills, tablets, and capsules at pharmacies, but these machines continually need adjustment and are not very reliable. Moreover, they do not operate very quickly, so that packaging process is somewhat time-consuming. In this regard, one machine of current manufacture enables pills, tablets, or capsules to be displaced from a tray into pockets formed in a paper strip and thereafter seals a transparent strip over the pocket, thereby capturing the pills, tablets, or capsules in the pockets. The machine advances the paper strips past a forming station where the pockets are produced, a loading station where the pills, tablets, or capsules are loaded, and a heat sealing station where the transparent strip is secured. It also advances the strip with the pills, tablets, or capsules embedded in it past a cutting station where the strip is severed into individual packages, each containing a single pill, tablet, or capsule. It is not uncommon for the cutter of this machine to drift out of phase with the advancing mechanism for the strips so that the strips are not severed precisely between successive pockets. In this regard, the machine utilizes cams to operate various mechanisms, and the cam followers at some of these mechanisms are spring loaded so they can turn the camshaft once the power to it is released. Moreover, the drive mechanism uses a one-way clutch. Thus, if the power is shut off, the clutch will accommodate any backslip of the drive mechanism without moving or otherwise disturbing the overlying strips, but when the machine is restarted, its drive mechanism will no longer be synchronized with the cutting mechanism in the sense that cuts are made midway between successive pockets. Also, the machine is capable of loading pills, tablets, or capsules only into a single row of pockets, and therefore operates relatively slowly. Furthermore, the machine tends to agitate the strip in which the pockets are formed, sometimes displacing the pills, tablets, or capsules from their pockets or disrupting the heat sealing mechanism. A machine of this type is disclosed in U.S. Pat. No. 4,068,448.

SUMMARY OF THE INVENTION

One of the principal objects of the present invention is to provide a machine for efficiently packaging small objects, such as medicinal pills, tablets, and capsules, with a minimum amount of manual labor. Another object is to provide a machine of the type stated which packages the pills, tablets, or capsules two at a time. A further object is to provide a machine of the type stated which prints information concerning the objects being packaged on the material from which the package is formed. An additional object is to provide a machine of the type stated in which the packaging material is advanced incrementally, and the incremental advance can be adjusted with considerable precision. Still another object is to provide a machine of the type stated in which the advancing mechanism and cutting mechanism remain synchronized so that the cuts which sever the individual packaged pills, tablets, or capsules are made at the correct locations in the packaging material. Yet another object is to provide a machine which is simple in construction, easy to operate, and highly reliable. Another object is to provide a machine of the type stated which does not unduly agitate the material in which the small objects are placed so the small objects remain in place until the package is closed. These and other objects and advantages will become apparent hereinafter.

The present invention resides in a machine including means for advancing a carrying strip and a covering strip along a path, with the latter entering the path after the former; forming means for creating pockets in the carrying strip, with the pockets being in two rows; loading trays on each side of the path; a divider rail between the trays and also between the two rows of pockets in the carrying strip so as to separate the rows and thereby facilitate manipulation of small objects from the trays into the pockets; and sealing means for sealing the covering strip to the carrying strip together around the pockets. The invention also resides in a machine having drive means for advancing a carrying strip and covering strip incrementally along a path; forming means for producing pockets in the carrying strip; loading means for facilitating loading of small objects into the pockets; sealing means for sealing the covering strip to the carrying strip around the pockets in the carrying strip; a camshaft for operating the drive means and also the sealing means such that the latter seals during the dwell between incremental advances of the strips; an electric motor coupled to the camshaft; and brake means for preventing rotation of the camshaft when the motor is de-energized. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur FIG. 1 is a perspective view of a machine constructed in accordance with embodying the present invention, the machine being particularly adapted for packaging small objects such as medicinal pills, tablets and capsules;

FIG. 3 is a sectional view taken along line 3—3 of FIG. 2 and showing the operating mechanism for the printing station;

FIG. 12 is a perspective view showing packages that are derived from the machine of the present invention.

DETAILED DESCRIPTION

Figure 2:
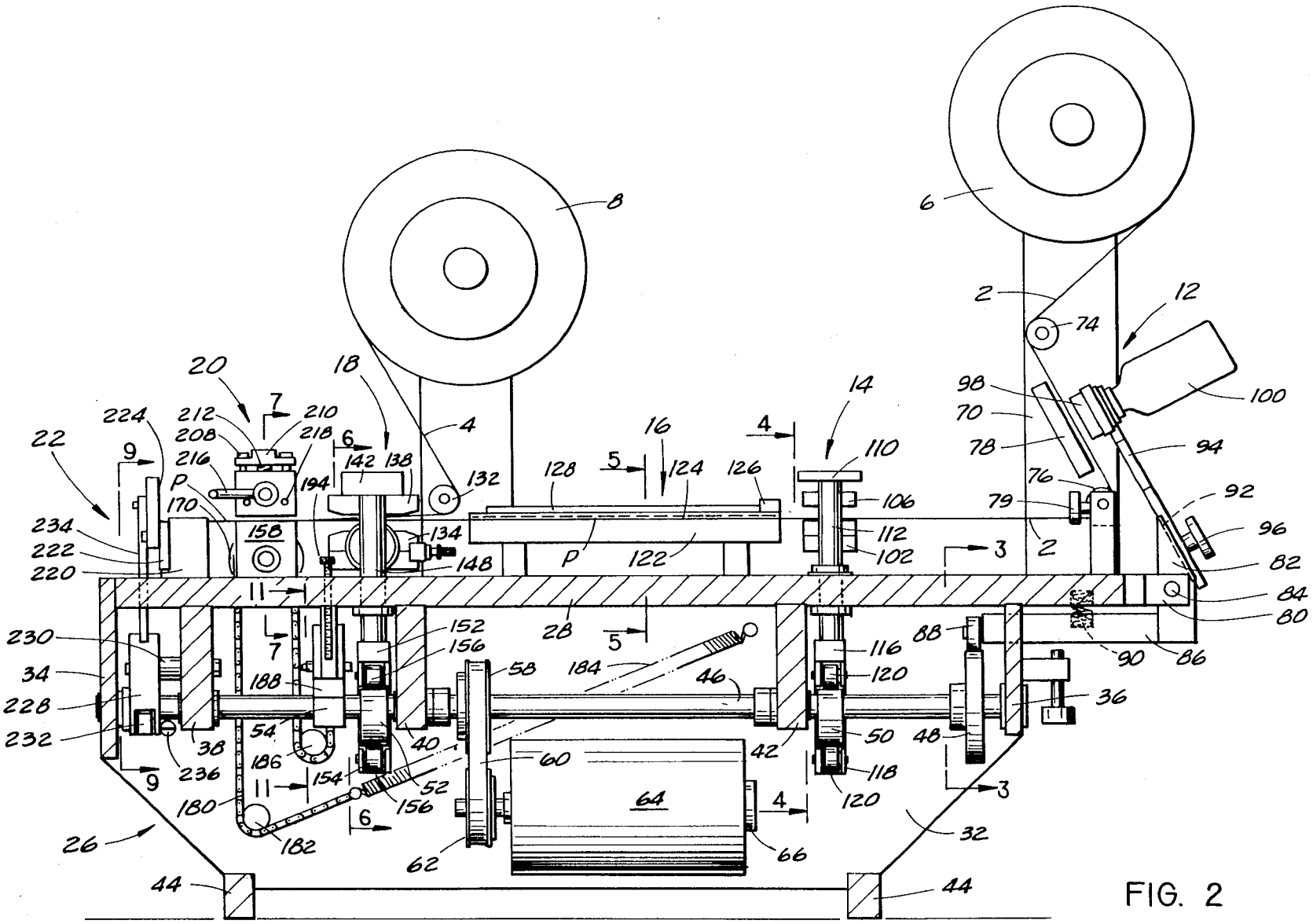
FIG. 2 is a sectional view taken along line 2—2 of FIG. 1 and showing the interior of the machine housing in elevation.

Referring now to the drawings, a packaging machine A (FIG. 1) is utilized by an operator to package small solid objects, such as pills, tablets, or capsules, in individual packages C (FIG. 12), each of which bears a printed inscription concerning the packaged object, such as in the case of medicines, the name of the medication. The individual packages C are derived from a strip 2 of carrying material and a strip of covering material, the two strips 2 and 4 being equal in width and supplied in rolls 6 and 8, respectively, that are supported on the machine A. The strip 2 of carrying material should be capable of retaining a shape into which it is deformed, and preferably the strip 2 is a laminate consisting of a paper backing, a metal foil over the backing and a sealant coating, such as polyethylene, covering the foil. The strip 4 of covering material may be a film of transparent material that is capable of withstanding relatively high temperatures, and a transparent sealant, such as polyethylene, on the back face of the transparent material. The sealants for the two strips 2 and 4 should of course be compatible, and should melt at a temperature considerably below that at which the paper backing will scorch or the temperature at which the transparent film will melt. Each package C consists of a segment of the carrying strip 2 in which a pocket 10 exists, a small object such as a medicinal pill, tablet, or capsule in the pocket 10, and a segment of the covering strip 4 located over the segment of the carrying strip 2. Moreover, the two segments are joined firmly together around the pocket so that small solid object is captured within the pocket 10. The pockets 10 have tapered side walls so that the objects when inserted into them tend to migrate toward their centers. The printed inscription appears on the paper backing of the segment of the carrying strip 2.

The carrying strip 2 moves along a path P that extends over the machine A, while the covering strip 4 moves over only a portion of the path P and where the covering strip 4 is along the path P, it overlies the carrying strip 2 (FIGS. 1 & 2). Along the path P the carrying strip 2 encounters six work stations, three of them in conjunction with the covering strip 4. In particular, the carrying strip 2 first passes through a printing station 12 where appropriate inscriptions are printed on its paper backing. Next comes a forming station 14 where the pockets 10 are formed in the carrying strip 2, the pockets 10 being arranged side-by-side in two rows. Thereafter the strip 2 passes through a loading station 16 where the prescribed small objects, which are normally pills, tablets or capsules, are loaded into the pockets 10. Immediately beyond the loading station, the covering strip 4 passes downwardly over the carrying strip 2 and the two strips 2 and 4 move together through a heat sealing station 18 where they are joined together around the pockets 10. Then comes a drive and perforating station 20 where the joined together strips 2 and 4 are perforated longitudinally intermediate the two rows of pockets 10. The strips 2 and 4 are also driven from the station 20 such that they advance incrementally along the path P, there being a slight dwell between each incremental advance. Finally, the joined together strips 2 and 4 pass through a cutting station 22 where they are cut transversely to sever the package C in combinations of two from the remainder of the joined together strips 2 and 4. Of course, each combination of two packages C is divided by perforations, and can therefore easily be separated along the perforations into individual packages C.

The machine A includes (FIGS. 1 & 2) a housing 26 that has a top wall 28, parallel front and back walls 30 and 32, end walls 34 and 36, and intermediate walls 38, 40 and 42 arranged in that order from the left end walls 34 to the right end wall 36. Each of the intermediate walls 38, 40 and 42 is secured firmly to the top wall 28 and is also bolted to the front and back walls 30 and 32. The entire housing 26 rests on cross members 44 which are attached to the front and back walls 30 and 32, and the cross members 44 in turn rest on a supporting surface which may be the top of a table. The path P is for the most part located along the top wall 28.

The housing 26 contains a camshaft 46 (FIG. 2) which extends substantially the entire length thereof parallel to the top wall 28 and to the front and back walls 30 and 32 as well. The camshaft 46 rotates in bearings fitted into each of the walls 34, 36, 38, 40, and 42, and has five cams 48, 50, 52, 54, and 56 on it. The first cam 48 is located adjacent to the right end wall 36 and services the printing station 12. The next cam 50 is located directly beneath the forming station 14 which it services. The cam 52, on the other hand, is directly beneath the sealing station 18 and services that station. The cam 54 is in the region of drive and perforating station 20 and effects the incremental advance of the two strips 2 and 4 along the path P. Finally, the cam 56 is immediately below the cutting station 22 which it services. The camshaft 46 also carries a cogged pulley 58 over which a timing belt 60 passes. The belt 60 passes over another cogged pulley 62 on a gear motor 64 that is mounted on the back wall 32. Being connected through timing belt 60, the motor 64 and camshaft 46 are positively coupled. The motor 64 is further provided with a solenoid actuated brake 66 which clamps down upon its armature shaft and prevents rotation of that shaft, once the electric power to motor 64 is cut off. This prevents rotation of the camshaft 46 as well.

The housing 26 also has posts 70 and 72 (FIGS. 1 & 2) attached to its back wall 32, and these posts project upwardly beyond the top wall 28 and support the rolls 6 and 8 of carrying strip 2 and covering strip 4 such that the two strips 2 and 4 when withdrawn from their respective rolls 4 and 6 align with and lead into the path P. In this regard, the post 70 is located ahead of the post 72 in terms of the positioning of the stations, the former being at the printing station 12 while the latter is between the loading and sealing stations 16 and 18.

The carrying strip 2 is wound into the roll 6 with its sealant presented inwardly, and immediately beyond the roll 6 it passes around a roller 74 which directs it back toward another roller 76 around which it also passes. The rollers 74 and 76 are positioned such that the carrying strip 2 between them assumes a direction oblique to the housing top wall 28. Here the strip 2 passes over an oblique backing plate 78 with its sealant coated surface being presented toward the plate 78, leaving the paper backing exposed. The plate 78 is mounted firmly upon and projects outwardly from the post 70. Beyond the roller 76 the carrying strip 2 assumes a horizontal disposition for the remainder of the path P and in so doing extends over the housing 26 generally parallel to its top wall 28. The shaft on which the roller 76 revolves is capable of pivoting in a horizontal plane, and the angle that it assumes with respect to the post 70 is controlled by a thumb screw 79 (FIG. 1). By adjusting the screw 79, it is possible to position the roller 76 such that the carrying strip 2 tracks perfectly with respect to the path P.

Directly below the roller 76, the top wall 28 has a bifurcated bracket 80 (FIG. 2) secured against its rear edge, and the bracket 80 supports a pivot block 82, the two being joined by a pivot pin 84 which enables the block 82 to pivot toward and away from the backing plate 78 and the portion of the carrying strip 2 which passes over it. The block 82 has an actuating arm 86 which extends underneath the top wall 28, terminating at the cam 48 where it is fitted with a roller follower 88 that rides the peripheral surface of the cam 48 (FIG. 3). The arm 86 is urged downwardly by a spring 90 which is interposed between the arm 86 and the housing top wall 28. This, of course, keeps the roller follower 88 against the cam 48.

The pivot block 82 has a relatively wide and shallow channel 92 extending upwardly in it and the bottom of this channel is generally parallel to the backing plate 78. The channel 92 receives the end of a stencil holder 94 which is secured to the block 82 by a thumb screw 96 and projects upwardly out of the channel 92 where it overlies the backing plate 78 and the portion of the carrying strip 2 which extends across the plate 78. The stencil holder 94 carries a stencil 98 and an ink container 100 which supplies ink to the back of the stencil 98. Normally, the stencil 98 is spaced from the carrying strip 2 at the backing plate 78, but when the roller follower 88 of the actuating arm 86 rides off of the lobe for the printing cam 48, which occurs during the dwell between successive advances of the strip 2 along the path P, the spring 90 forces the arm 86 downwardly which, in turn, rocks the pivot block 82 and the stencil holder 94 forwardly. This brings the stencil 98 against the paper backing on the carrying strip 2 so as to print information on the strip 2. When the thumb screw 96 is loosened, the stencil holder 94 may be moved upwardly or downwardly, and this enables the location at which the stencil 98 prints on the carrying strip 2 to be adjusted with considerable precision.

The carrying strip 2 passes off of the lower roller 74 in a horizontal disposition and extends along the top wall 28 of the housing 26 slightly upwardly from that wall (FIG. 2). In so doing, the strip 2 passes through the forming station 14, the loading station 16, the sealing station 18, the driving and perforating station 20, and the cutting station 22, all in that order.

At the forming station 14 the top wall 28 of the housing 26 has a forming die 102 (FIGS. 2 & 4) secured firmly to it such that the carrying strip 2 passes directly over the die 102. In this regard, the die 102 has a flat upper surface which is located at about the elevation of the carrying strip 2. The die 102 also has two cavities 104 which open upwardly out of the flat upper surface, these cavities being located side-by-side.

Directly over the die 102 is a pressure plate 106 (FIGS. 2 & 4) and two punches 108 which extend through the pressure plate 106 and are capable of shifting in the vertical direction with respect to it. The punches 108 align with the cavities 104 in the die 102, and at their lower ends are beveled to the configuration desired for the pockets 10 that are to be imparted to the carrying strip 2. Normally, the pressure plate 106 and punches 108 are supported above the die 102 so the carrying strip 2 may pass freely over the die 102, but when the plate 106 and punches 108 are forced downwardly, the carrying strip 2 is clamped between the plate 106 and the die 102. Thereafter, the punches 108 move through the plate 106 and deform the strip 2 to produce the two side-by-side pockets 10.

The pressure plate 106 and punches 108 are carried by a cross plate 110. The punches 108 are secured firmly and directly to the cross plate 110, while the plate 106 is suspended from the cross plate 110 with screws 111 and indeed is urged away from the plate 113 with compression springs 112. The screws 111 slide within the plate 110 and this enables the punches 108 to project through and beyond the plate 106 when the plate 106 bottoms out on the die 102. The cross plate 110 extends laterally beyond the sides of pressure plate 106 where it is attached to a pair of posts 113 which extend downwardly into the interior of the housing 26. To this end, the top wall 28 of the housing 26 is fitted with bushings 114 which enable the posts 113 to move upwardly and downwardly, but confine it in all other directions. Within the housing 26 the lower ends of the two posts 113 are connected by a cross block 116 to which a yoke 118 is attached. The yoke 118 fits around the cam 50 and has roller followers 120, there being one directly above the cam 50 and another directly below it. Thus, as the cam 50 turns within the yoke 118, it moves the yoke 118 upwardly and downwardly. The pressure plate 106 and punches 108, being attached to the yoke 118 through the cross plate 110, the posts 113 and the cross block 116, likewise experience the same reciprocal movement. Indeed, this movement is such that pressure plate 106 and punches 108 move from an elevated position in which they are spaced sufficiently from the die 102 to enable the carrying strip 2 to move easily through the forming station 14, to a depressed position in which the strip 2 is clamped firmly between the die 102 and plate 106 and the beveled lower ends of the punches 108 are projected into the cavities 104 where they deform the carrying strip 2 into the cavities 104. The yoke 118 enables the entire reciprocal movement of the punches 108 to remain under control of the cam 50. The tapered side walls of the pockets 10, on the other hand, enable the deformed portions of the carrying strip 2 to move out of the die 102 upon the next incremental advance of the strip 2, even though the die 102 remains fixed in position at the same elevation.

Figure 5:
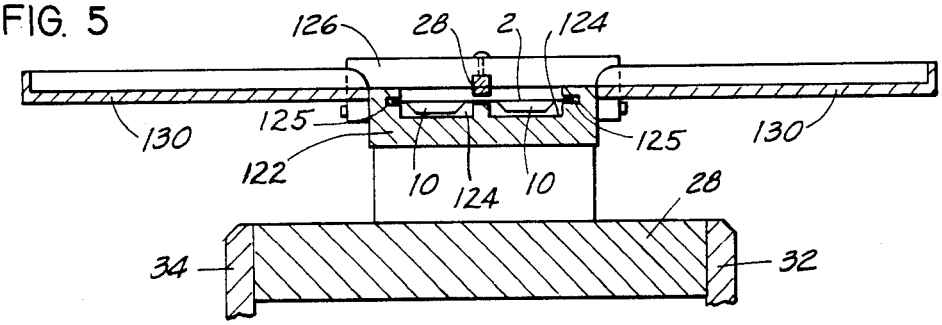
FIG. 5 is a sectional view taken along line 5—5 of FIG. 2 showing the loading station.

At the loading station 16, which is next, the top wall 28 of the housing 26 supports a track 122 (FIGS. 1 & 5) having upwardly opening channels 124 that are located side-by-side, each being wide enough to accomodate a row of pockets 10 formed in the carrying strip 2 at the forming station 14. While the pockets 10 of the strip 2 fit into and move through the channels 124, the side edges of the strip 2 are received in grooves 125 that open inwardly from the track 122, with the grooves 125 being located at about the same elevation as the upper surface of forming die 102 so that the carrying strip 2 remains horizontal between the forming and loading stations 14 and 16.

At its end located adjacent to the forming station 14 the track 122 has a bridge piece 126 fastened to it. The bridge piece 126 extends across the channel 124 and carries a divider rail 128 which extends along the center of the track 122 and overlies the portion of the track 122 that separates the two channels 124. Moreover, the divider rail 128 is spaced far enough from the track 122 to enable the portion of the carrying strip 2 that is between the two rows of pockets 10 to pass easily beneath it without distorting the pockets 50 within it.

In addition to the track 122 and its dividing rail 128, the loading station 16 has front and rear loading trays 130 (FIGS. 1 & 5) which are attached to the sides of track 122 and project laterally from it, with the front tray projecting forwardly away from the front section of the channel 124 and the rear tray 130 projecting rearwardly away from the rear section. Moreover, the upper surface of each tray 130 is located slightly higher than that side of the track 122 along which it is located, so that small objects which are placed on the tray 130 may be manipulated with ease into the pockets 10 of the strip 2 while the strip 2 is within the channel 124.

The post 72 which carries the roll 8 of the covering strip 4 is located at the end of the loading station 16. It is provided with a guide roller 132 which extends outwardly over the carrying strip 2. The covering strip 4 passes underneath guide roller 32 where it joins the path P, it being at this point laid directly over the carrying strip 2 with its sealant coating presented downwardly toward the sealant coating on the carrying strip 2.

At the sealing station 18 (FIGS. 2,6 & 10), which follows the loading station 16, the top wall 28 of the housing 26 supports a platen 134, the upper surface of which is located at about the same elevation as the bottom of the track 122. The platen 134, however, contains cavities 136 which are arranged in two rows that align with the rows of pockets 10 in the carrying strip 2. The cavities 136 are also slightly deeper than the pockets 10 and open out of each end of the platen 134. Furthermore, the cavities 136 of each row are separated by a rib 137 (FIG. 10) that rises to the upper surface of the platen 134. The location of the platen 134 is such that each incremental advance of the carrying strip 2 will deposit a different set of pockets 10 above the cavities 136, so the pockets 10 will drop down into the cavities 136, leaving the adjacent portion of the carrying strip 2 on the upper surface of the platen 134. The platen 134 includes an internal heating element which elevates its temperature sufficiently to activate the sealants on the two strips 2 and 4 without damaging the other materials of the strips 2 and 4.

Immediately above the platen 134 (FIGS. 2,6 & 10) is a pressure plate 138 that moves upwardly and downwardly with respect to the platen 134. When in the upper position the two strips 2 and 4 are free to move between the plate 134 and plate 138, while in the lower position the two strips 2 and 4 are clamped tightly between the platen 134 and plate 138 in the areas surrounding the set of pockets 10 in the strip 2. In this connection, the pressure plate 138 also has cavities 140 which have the same peripheral configuration as the cavities 136 in the platen 134, and furthermore register with those cavities.

The pressure plate 138 is carried by a cross plate 142, it being suspended from the plate 142 on machine screws 144 which pass through the cross plate 142 and thread into the pressure plate 138. Around each screw 144 is a compression spring 146 which urges the pressure plate 138 downwardly. At its ends the cross plate 142 is attached to posts 148 which extend downwardly through bushings 150 in the top wall 28 of the housing 26. The bushings 150 permit the posts 148 to reciprocate upwardly and downwardly, but otherwise confine the posts 148. The lower ends of the two posts 148 are connected to a cross block 152 which is located within the housing 26 immediately above the cam 52. The block 152 in turn has a yoke 154 attached firmly to it, and the yoke 154 fits around the cam 52 where it is provided with two roller followers 156, one being directly above the cam 52 and the other being directly below the cam 52. As the cam 52 rotates within the yoke 154 it moves the yoke 154 upwardly and downwardly, and this reciprocal movement is transmitted to the cross plate 142 through the posts 148, thereby causing the plate 142 to move between elevated and depressed positions. In the former, the pressure plate 138 is held high enough above the platen 134 to enable loaded pockets 10 within the carrying strip 2 and the overlying covering strip 4 to pass between the plate 138 and platen 134. In the depressed position, the pressure plate 138 is seated firmly over the two strips 2 and 4 which are, in the areas between successive pockets 10 and in the areas along the sides of the pockets 10, compressed tighly beteen the platen 134 and plate 138. Indeed, in the descent of the pressure plate 138 to its depressed position, the plate 138 bottoms out against the strips 2 and 4 before the yoke 154 reaches the bottom of its stroke and as a consequence the springs 146 undergo further compression at the bottom of the stroke. Thus, the springs 146 exert the compressive force on the two strips 2 and 4. The cam 52 is positioned such that the pressure plate 138 lowers while the strip 2 is in a dwell between incremental advances.

Since the temperature of the platen 134 is higher than that at which the sealant coatings of the two strips 2 and 4 melt, the coatings, when the strips 2 and 4 compressed together, are activated and fuse together, thus joining the two strips 2 and 4.

The driving and perforating station 20 (FIGS. 2 & 7) is located immediately beyond the sealing station 18, and it is as this station where the force for advancing the two strips 2 and 4 on an incremental basis is exerted on the strips 2 and 4. At the station 20 the top wall 28 of the housing 26 is provided with a pair of bearing blocks 158, there being one on each side of the path P occupied by the strips 2 and 4. The front bearing block 158 contains a rotational clutch 160 whereas the back bearing block 158 contains a conventional bearing 162 which aligns with the clutch 160, and extended through the clutch 160 and bearing 162 is a drive shaft 164. The clutch 160 is oriented such that the shaft 164 rotates counterclockwise when observed from the front of the machine A, but not clockwise. The shaft 164 projects rearwardly beyond the bearing 162 where it is fitted with a sprocket 166, the sprocket 166 being connected to the shaft 164 through another rotational clutch 168 which permits the sprocket 166 to turn the shaft 164 counterclockwise, but causes the sprocket 166 to merely rotate freely on the shaft 164 when rotated clockwise.

The portion of the shaft 164 that spans the space between the two bearing blocks 158 is fitted with a pair of drive rollers 170, each of which is provided with two knurled rims 172 separated by a groove 174. The rims 172 are all of the same diameter which is great enough to enable the rims 172 to reach the strip 2 as it passes out of the sealing station 18. The grooves 174 are wide enough and deep enough to accommodate the two rows of pockets 10 along the strip 2. Moreover, the one roller 170 is positioned such that the pockets 10 of the front row pass through its groove 174, while the other roller 170 is positioned such that pockets 50 of rear row pass through its groove 174. Hence, the rims 172 of the two rollers 170 contact the carrying strip 2 to the sides of the pockets 10 within that strip 2.

The two rollers 170 are secured firmly to the shaft 164 and between them is a thin steel disk 176 having teeth 178 which project radially beyond the rims 172. The teeth 178 pierce the overlying strips 2 and 4, and as the strips 2 and 4 advance through the station 20, the teeth 178 form a line of perforations between the two rows of pockets 10.

Extended over the sprocket 166 is a chain 180 (FIGS. 2,7,8 & 11) so that the sprocket 166 divides the chain 180 into two sections, both of which depend into the interior of the housing 26. The leading station passes downwardly to the bottom of the housing 26 where it passes around an idler sprocket 182 that is on the back wall of the housing 26. From the idler sprocket 182 the chain extends diagonally upwardly and at its end is attached to a tension spring 184 that is secured to the back wall 32 of the housing 26 (FIGS. 2 & 8). Thus, the spring 184, when extended, exerts a force on the chain 180, and that force translates a torque at the drive sprocket 180, with the torque being directed such that it rotates the drive shaft 164 and drive rollers 170 counterclockwise, that is in the direction which will advance the strips 2 and 4 along the path P.

The other depending section of the chain 180 passes around another idler sprocket 186 (FIG. 8), which is slightly higher than the idler sprocket 182, and upon rising form the sprocket 186 is connected to an arm 188 (FIG. 11) that pivots on a member 190 extended downwardly from the housing top wall 28 near the front wall 30. Thus, the spring 184, acting through the chain 180, urges the arm 188 downwardly. Between the member 190 and the chain 180 the arm 188 passes over the cam 54, and indeed directly over the cam 54 it is provided with a roller follower 192 which rolls along the periphery of the cam 54 as the camshaft 46 revolves. On the other side of the member 190 the housing top wall 28 is provided with a stop screw 194 which threads downwardly and aligns with top face of the arm 186 to serve as a stop for limiting and controlling distance the arm 186 can pivot downwardly toward the cam 54.

When the lobe of tha cam 54 passes under the roller follower 192 and raises the arm 186, the arm 186 draws the chain 180 downwardly over the drive sprocket 166 and causes the sprocket 166 to rotate clockwise. However, in that direction the sprocket 166 merely rotates freely on the shaft 164 due to the clutch 168. The other clutch 160 prevents any friction within the clutch 168 from rotating the shaft 164 backwardly, that is clockwise. Aside from rotating the sprocket 166, the elevation of the arm 188 also extends the tension spring 184 since the spring 184 accommodates the movement of the chain 180. As the roller follower 192 passes beyond the lobe of the cam 54, the arm 188 drops and the spring 184 draws the chain 180 back in the opposite direction, thereby turning the drive sprocket 164 counterclockwise. In this direction of rotation the clutch 168 engages the sprocket 166 with the drive shaft 164 and as a consequence the two rollers 170 and the perforating disk 176 between them also rotate. The rollers 170, being against the carrying strip 2 advance the joined together strips 2 and 4, while the teeth 178 on the disk 176 perforate the strips 2 and 4 midway between their side margins. The sprocket 166 rotates counterclockwise until the forward end of the arm 188 comes against the stop screw 194. Thus, the incremental advance of the strip 2 and 4 may be controlled with considerable precision by turning the stop screw 194.

The joined together strips 2 and 4 are held against the knurled rims 172 of the drive rollers 170 by pressure rollers 196 (FIG. 7) which are mounted on a common axle 198 with bearings so that the rollers 196 revolve on the axle 198. Each pressure roller 196 has a pair of knurled rims 200 and a groove 202 separating the rims 198, the rims 198 being located directly above and aligning with the rims 172 of the drive rollers 170, and the grooves 200 being opposite the grooves 174 of the drive rollers 170. Moreover, the two drive rollers 170 are separated slightly to accommodate the teeth 178 of the perforating disk 176.

The axle 198 at its ends has eccentric portions 204 which are confined in floating blocks 206 (FIG. 7) that are located directly above the bearing blocks 158. The floating blocks 206 ride upwardly and downwardly on guide posts 208 that project upwardly from the bearing blocks 158, and the two guide posts 208 of each block 158 are at their upper ends connected by a cap 210 that houses a compression spring 212 which urges the underlying block 206 downwardly. The eccentric portion 204 at the front end of the axle 198 projects beyond the front block 206 where it is fitted with a collar 214 having an operating handle 216 extended from it. The front block 206 also has stops 218 which lie in the path of the handle 216 and permit it to rotate the axle 198 through an angle of about 180°. When the handle 216 is against one of the stops 218 the floating blocks 206 are seated on the bearing blocks 158 and the pressure rollers 196 are separated from the underlying drive rollers 170 so that the strip 2 and 4 may be threaded between the rollers 170 and 196. On the other hand, when the operating handle 216 is against the other stops 218, the floating blocks 206 are elevated off of the bearing blocks 158, and the springs 212 urge the pressure rollers 196 downwardly toward the drive rollers 170 so that the strips 2 and 4 will be captured snugly between the knurled rims 172 and 200 of the rollers 170 and 196, respectively.

At the cutting station 22 (FIGS. 1, 2 & 9) is an anvil 220 which is secured firmly to the housing top wall 28 immediately beyond the bearing blocks 158. The anvil 220 has an upper surface which is slightly lower than the upper surfaces of the drive rollers 170 of the preceding station 20 so that the joined together strips 2 and 4 will, upon passing off of the drive rollers 170, move across the anvil 220. At its end the anvil 220 is fitted with a fixed knife blade 222 having a cutting edge that extends under the path P. The fixed blade 222 projects forwardly beyond the anvil 220 where a movable blade 224 is mounted upon it by means of a pivot pin 226, the movable blade 224 having a cutting edge that moves across the cutting edge of the fixed blade 222 as the movable blade 224 swings from an open position to a closed position. The movable blade has a series of equally spaced notches 225 that open out of its cutting edge.

The movable blade 224 is operated by the cam 56 at the end of the camshaft 46. More particularly, the housing 26 immediately outwardly form the cam 56 contains a bell crank 228 which pivots on a pin 230 that projects from the intermediate wall 38 of the housing 26. The bell crank 228 on one of its arms carries a roller follower 232 which bears against the peripheral surface of the cam 56. The other arm of the bell crank 228 is located near the top wall of the housing 26, and this arm is connected to the movable blade 224 by tie rod 234 and an eccentric pivot pin 235 that will turn with respect to the blade 224. Thus, the position of rotation for the pin 235 determines the extent to which the blade 224 will pass across the fixed blade 222. The lower arm of the bell crank 228 has a tension spring 236 extended from it to the back wall 32 of the housing 26, and this spring 236 maintains the roller follower 232 of the bell crank 228 against the peripheral surface of the cam 56.

During the dwell time for the strips 2 and 4, the lobe of the cam 56 forces the roller follower 232 outwardly toward the housing front wall 30, causing the bell crank 228 to pivot about its pin 230 such that it draws the tie rod 234 further into the housing 26. The tie rod 234, in turn, pivots the movable blade 224 downwardly a distance sufficiently to move its cutting edge across the cutting edge of the fixed blade 222. As a consequence, the blade cuts the joined together strips 2 and 4. The extent of the cut is controlled by the position of rotation for the pivot pin 235. In one position the pin 235 permits the blade 222 to sever the strips 2 and 4 completely, in which case the notches 225 descend past the cutting edge of fixed blade 222. In another position, the blade 224 does not descend for the full depth of the notches 225 and the cuts are merely perforations. The spacing between the drive rollers 170 at the station 20 and the fixed blade 222 at the station 22 is such that the joined together strips 2 and 4 are cut between the pockets 10.

The sealing station 18, the driving and perforating station 20, and the cutting station 22 are all enclosed by a cover which fits over the top wall of the housing 26.

The motor 64 which turns the camshaft 46 and the heating element which heats the platen 134 at the sealing station 18 are controlled by switches 238 (FIG. 1) mounted upon a small console 240 that is attached to the front wall 30 of the housing 26. The console 240 also has an electromechanical counter 242 that registers a separate count each time the knife blade 222 descends. The counter 242 may be reset.

OPERATION

To place the machine A in condition for operation (FIGS. 1 & 2), the roll 6 of the carrying strip 2 is installed upon the post 70 such that the strip 2 leads off of the back side of the roll 6. The strip 2 is then brought around the upper roller 74 and over the backing plate 78, and then around the lower roller 76. Beyond the roller 76 the strip 2 is threaded along the path P through the forming station 14, the loading station 16, the sealing station 18, the driving and perforating station 20, and the cutting station 22. More particularly, the gear motor 64 is energized until the punch plate 106 at the forming station 14, the pressure plate 138 at the sealing station 18, and the movable knife 224 at the cutting station 22 are all in their elevated positions. Then the strip 2 is threaded between the punch plate 106 and the forming die 102 at the forming station 14. Next, it is fitted under the bridge piece 126 and divider rail 128 at the loading station 16 and moved along the bottom of the track 122 until it emerges from the opposite end of the loading station 16. At this point the strip 2 is pulled still further and fitted through the space between the pressure plate 136 and the platen 134 at the sealing station 18. Next, the release handle 216 at the driving and perforating station 20 is turned to elevate the pressure rollers 196 so as to separate the knurled rims 200 of the pressure rollers 196 from the knurled rims 172 of the drive rollers 170. When the pressure rollers 196 are so disposed, the carrying strip 2 is inserted between them and pulled over the anvil 220 and fixed blade 222 at the cutting station 22. Since the movable cutting blade 224 is in its upper position, the end of the carrying strip 2 fits beneath it.

The covering strip 4 is likewise mounted upon its post 72 and withdrawn off of the back side of the roll 8 to fit beneath the guide roller 132. The end of the covering strip 4 is then threaded through the sealing station 18, the driving and perforating station 20, and the cutting station 22 in the same manner as the carrying strip 2, only it is passed over the upper surface of the carrying strip 2. Thereupon, the handle 216 is rotated to bring the pressure rollers 196 downwardly toward the drive rollers 170, and the two strips 2 and 4 are of course caught in the nip between the rollers 170 and 196.

The pills, tablets, capsules or other small objects which are to be packaged are placed upon the two loading trays 130 and a stencil 98 corresponding to the particular drug that is on the trays 130 is inserted in the stencil holder 94 in front of the ink container 100. Also, the heater for the platen 134 is energized and allowed a few minutes to bring the platen 134 up to its operating temperature.

Figure 11:
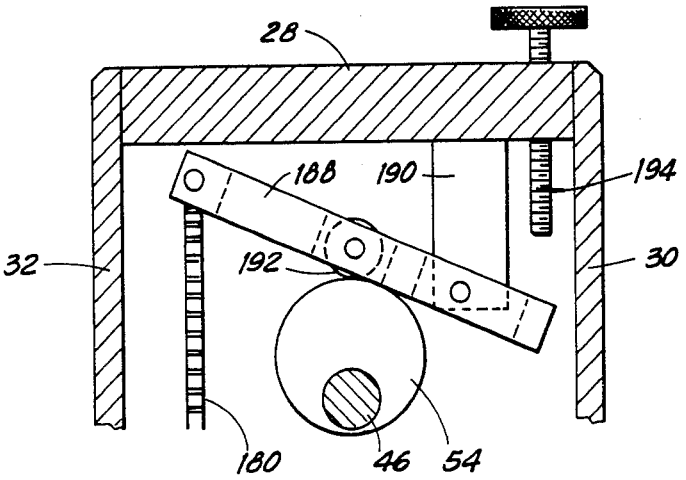
FIG. 11 is a sectional view taken along line 11—11 of FIG. 2 and showing the cam and arm for moving the chain that turns the rollers at the drive and perforating station.

After the platen 134 reaches its operating temperature the gear motor 64 is energized and it in turn rotates the camshaft 46. Considering first the cam 54 at the driving and perforating station 20, it elevates the actuating arm 188, causing it to swing upwardly about the pivot member 190 (FIG. 11). This causes the chain 180 to move downwardly over the back of the drive sprocket 164 (FIG. 8). As the lobe of the cam passes off of the roller follower 192, the actuating arm 188 descends under the force exerted by the tension spring 184 and this of course allows the chain 180 to move back to its original position. In so doing, the chain 184 rotates the drive sprocket 166 counterclockwise and when so rotated the clutch 168 engages the drive shaft 164, turning the two drive rollers 170 in unison. Since the strips 2 and 4 are forced into the knurled rims 72 of the drive rollers 170, the strips 2 and 4 advance in unison, and as they advance the teeth 178 of the perforating disk 176 penetrate the strips 2 and 4 midway between their side margins, creating a row of perforations. The advance continues until the arm 188 comes to rest against the bottom of the stop screw 194. Thus, for each rotation of the camshaft 46, the strips 2 and 4 are advanced an equal distance along the path P.

Of course, as the strips 2 and 4 advance the cam 48 at the printing station 12 holds the stencil 98 away from the back of the carrying strip 12. Likewise, the cam 50 at the forming station 14 maintains the punch plate 106 in its elevated position and the same holds true at the sealing station 18, the cam 52 at that station holding the pressure plate 138 in its elevated position. Also, the cam 56 at the cutting station 22 maintains the movable blade 224 in its open position above the path P. Thus, the punch plate 106, the pressure plate 138 and the cutting blade 224 do not impede the movement of the strips 2 and 4 along the path P.

However, once the drive rollers 170 have come to rest and the strips 2 and 4 are in the dwell between incremental advances that is during the time when the cam 54 at the driving and perforating station 20 is elevating the arm 188 to retract the chain 180 and expand the tension spring 184, the cam 48 at the printing station 12 allows the arm 86 of the pivot block 82 to drop downwardly under the force exerted by the compression spring 90 (FIGS. 2 & 3). As a consequence, the pivot block 82 swings forwardly and brings the stencil 98 against the back side of the carrying strip 2 so that the information on the stencil 98 is imparted to the carrying strip 2.

Figure 4:
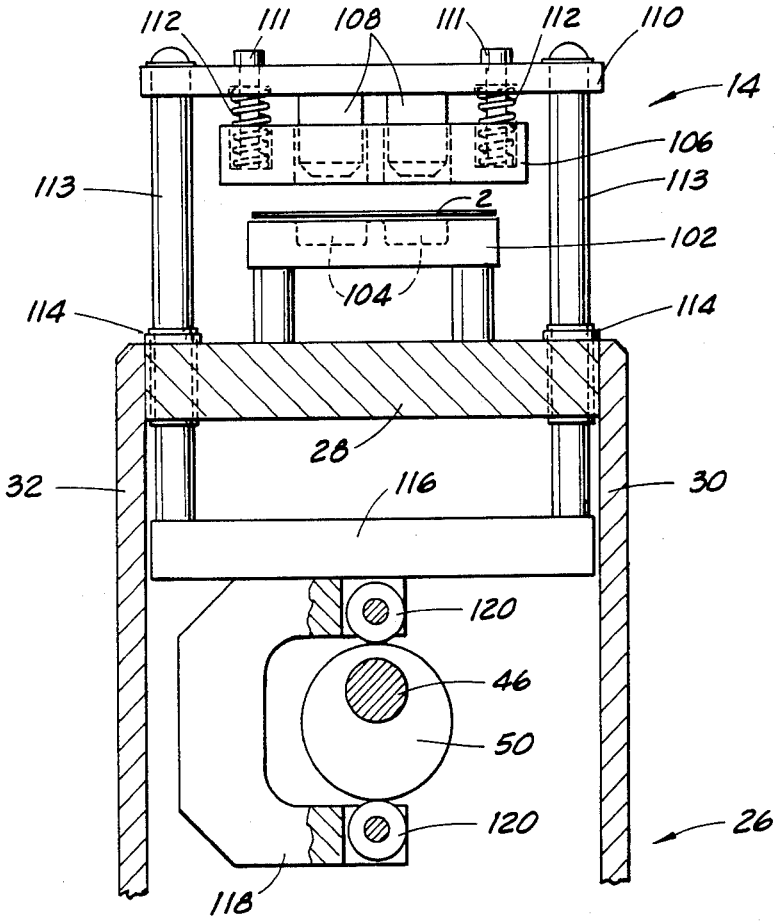
FIG. 4 is a sectional view taken along line 4—4 of FIG. 2 and showing the forming station.

At the forming station 14, the cam 52 forces the punch plate 106 downwardly so that the punches 108 upon it enter the cavities 104 in the forming die 102 (FIG. 4). Since the strip 2 is between the plate 106 and the die 102, the portions of it that underlie the punches 108 are driven into the cavities 104 and assume the shape of the cavities 104. In short, each time the punch plate 106 descends, a pair of pockets 10 are formed in the carrying strip 2.

As the pockets 10 move through the channel 124 in the track 122 at the loading station 16 (FIGS. 1 & 5) an individual using the fingers and thumb of one hand manipulates a pill, tablet, capsule or other small object from each loading tray 130 into the adjacent pockets 10 of the carrying strip 130. In this regard, the two rows of pockets 10 that are formed in the carrying strip 2 are separated by the divider rail 128 so the operator can easily load two pockets 10 simultaneously, one with the thumb that is located over the front tray 130 and the other with a finger that is over the back loading tray 130. As the loaded pockets 10 pass off the end of the track 122, the covering strip 4 drops over the carrying strip 2 and the two strips 2 and 4 advance simultaneously to the sealing station 18.

Figure 10:
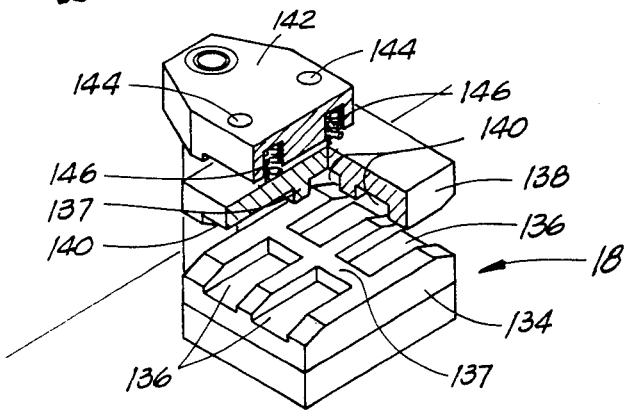
FIG. 10 is a perspective view, partially broken away and in section, of the heating platen and pressure plate at the sealing station.
Figure 6:
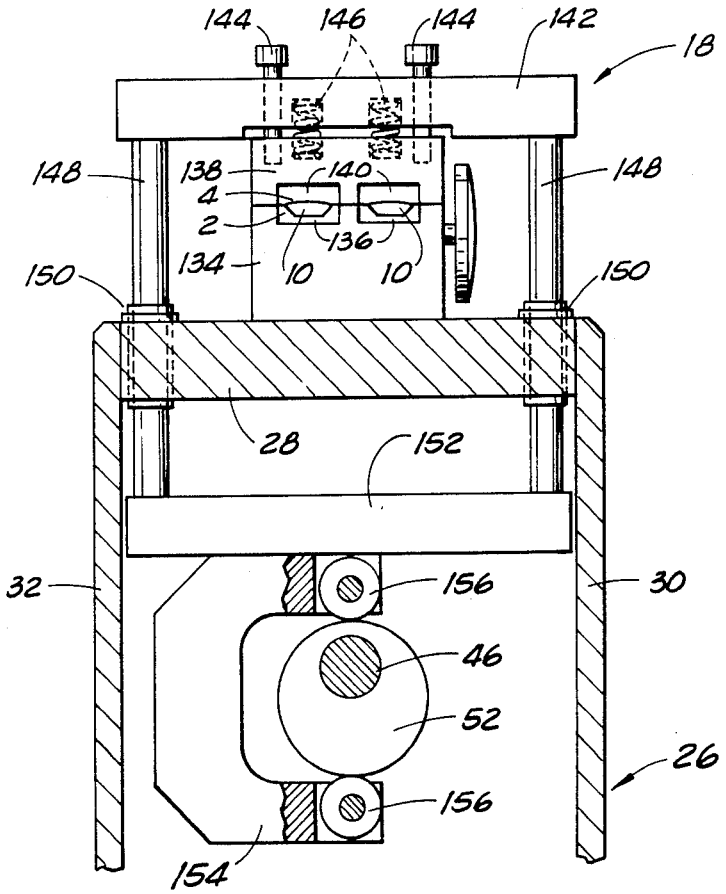
FIG. 6 is a sectional view taken along line 6—6 of FIG. 2 and showing the sealing station.

During the dwell time for the strips, the cam 52 at the sealing station 18 drives the pressure plate 138 downwardly, causing the pressure plate 138 to come against the covering strip 4 (FIGS. 6 & 10). Actually, the two strips 2 and 4 are compressed tightly between the upper surface of the platen 134 and the bottom surface of the pressure plate 138 with the force of the cam 52 being exerted through the compression springs 146 that bear against the top of the pressure plate 138. Since the plate 134 and the pressure plate 138 have cavities 136 and 140, respectively, that correspond in configuration to the pockets 10, the force is only applied in the areas along the peripheries of the pockets 10. As the force is applied, the heat from the platen 134 melts the sealant coatings on the strips 2 and 4, causing those coatings to fuse together and thereby securely join the covering strip 4 to the carrying strip 2 in the areas along the peripheries of the pockets 10.

Figure 7:
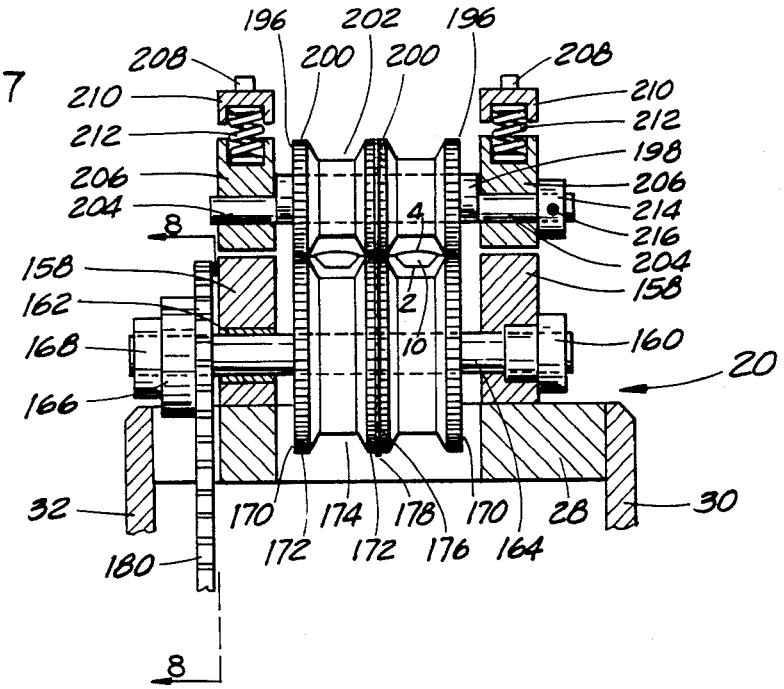
FIG. 7 is a sectional view taken along line 7—7 of FIG. 2 and showing the drive and perforating station.
Figure 8:
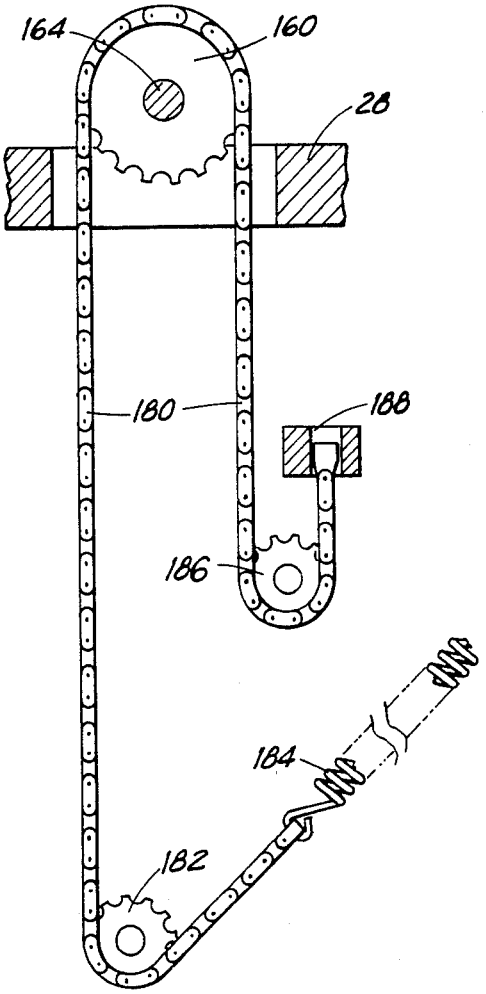
FIG. 8 is a sectional view taken along line 8—8 of FIG. 7 and showing the drive mechanism for the rollers at the drive and perforating station.

As previously mentioned, the joined together strips after emerging from the sealing station pass through the driving and perforating station 20 where a row of perforations is imparted by the teeth 178 of the perforating disk 176 (FIG. 7).

Figure 9:
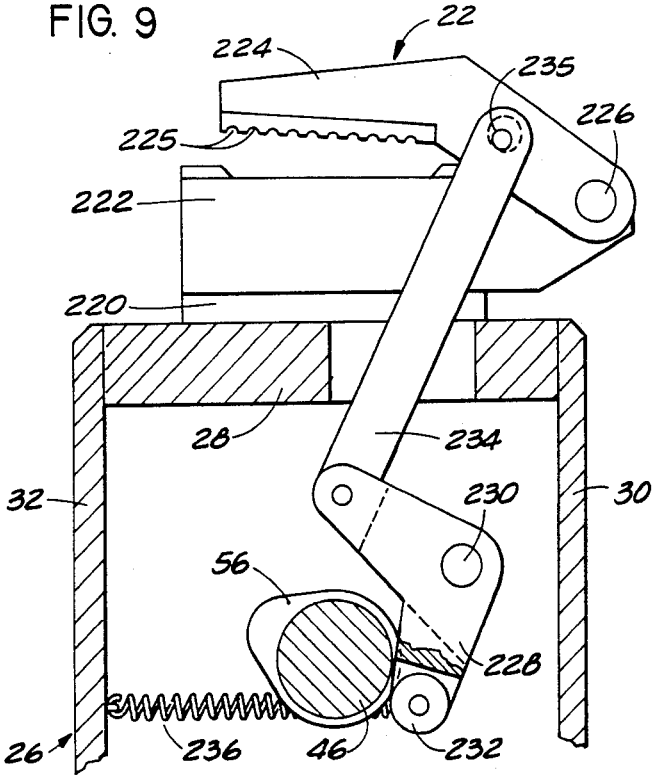
FIG. 9 is a sectional view taken along line 9—9 of FIG. 2 and showing the sealing station.

During the dwell period of the strips 2 and 4, the cam 56 at the cutting station moves the bell crank 228 such that it pivots the movable blade 224 downwardly, causing it to wipe across the edge of the fixed cutting blade 222 and sever the strips 2 and 4 transversely between successive pockets 10 of each row (FIG. 9). This leaves two side by-side packages C joined at a row of perforations. These packages C are separated by tearing them along the perforations.

The advance of the joined together strips along the path P is controlled with a high degree of precision at the stop screw 194 (FIG. 11). As a consequence, the cuts are made precisely at the proper location, and the pockets 10 that are formed at the forming station 14 align precisely with the cavities 136 and 140 in the platen 134 and overlying pressure plate 138 at the sealing station 18. Also, the cuts are formed precisely between successive pockets 10 instead of perhaps through the pockets 10 as could well occur if the machine A were out of adjustment. Also, the thumb screw 96 at the printing station 12 enables the stencil holder 94 to be moved upwardly or downwardly to ensure that the printed inscription appears directly behind the pockets 10 and not in the region of a cut. Each time the chain 180 retracts with the elevation of the arm 188, the drive shaft 164 remains firmly in place and does not retract with it, inasmuch as the clutch 160 prevents the drive shaft 164 from moving in the reverse direction.

If the gear motor 64 is turned off to stop the advance, the brake 66 is immediately energized to prevent any further rotation of the motor armature and the cam shaft 46 to which it is connected. In this regard, the two are coupled through the timing belt 60 so that the camshaft 46 cannot slip with respect to the motor 64. As a consequence, the force exerted by the tension spring 184 through the chain 180 and arm 189 cannot rotate the camshaft 46 backwardly if for some reason the machine is stopped with the cam 56 on the rise to the top of its lobe. If this occured, then the sprocket 166 might free wheel backwardly and prevent the cutting station 22 from producing cuts at the proper location.

The machine enables two pills, tablets, capsules or other small objects to be loaded at once, each from a different side of the track 122. This greatly increases the capacity of the machine to package medicines. Because the side walls of the pockets 10 are tapered downwardly to the bottom walls of the pockets 10, the pills, tablets or capsules tend to center themselves in the pockets 10 and remain centered as the strip 2 advances. In short the pills, tablets or capsules remain in the proper position for sealing the covering strip 4 to the carrying strip 2. Aside from that, the divider rail 128 at the loading station 16 holds the strip 2 downwardly within the track 122 despite the reciprocal movement of the punch plate 106 and the pressure plate 138 beyond each end of the track 122. This further insures that the pills, tablets or capsules, once they are loaded, remain in the pockets 10.

This invention is intended to cover all changes and modifications of the example of the invention herein chosen for purposes of the disclosure which do not constitute departures from the spirit and scope of the invention.

What is claimed is:

1. A machine for packaging small solid objects between a carrying strip and a covering strip, said machine comprising: means on the machine defining a path along which the carrying strip moves including a track which is located intermediate the ends of the path and supports the carrying strip in a horizontal orientation; drive means for advancing the carrying strip along the path and for also simultaneously advancing the covering strip along a portion of the path that is beyond the track, with the covering strip overlying the carrying strip along said portion of the path; forming means located along the path ahead of the track for producing pockets arranged in two rows in the carrying strip with the pockets being oriented such that they open upwardly at the track; a pair of loading trays located on opposite lateral sides of the track for supporting small solid objects generally above and to the sides of the portion of the carrying strip that passes along the track and between the trays, so that the objects on the trays can be manipulated into the pockets of the carrying strip; a divider rail located between the two trays, the divider rail being slightly above the carrying strip to prevent the carrying strip from rising upwardly off of the track and further being between the two rows of pockets in the carrying strip so as to separate the rows, whereby the objects on the one tray are manipulated into the pockets of the one row and the objects on the other tray are manipulated into the pockets of the other row; and sealing means for sealing the covering strip to the carrying strip along the areas of the two strips that surround the pockets.

2. A machine according to claim 1 and further comprising a bridge piece mounted on the track such that it extends over the path and the carrying strip that is along the path; and wherein the divider rail is attached to the bridge piece.

3. A machine according to claim 2 wherein the bridge piece is located at the beginning of the track and the divider rail is attached to the bridge piece such that it is cantilevered over the path that is along the track.

4. A machine according to claim 1 wherein the track has a channel through which carrying strip extends.

5. A machine according to claim 1 wherein the forming means includes a fixed die having an upper surface over which the carrying strip passes and cavities that open out of the surface side-by-side, the surface being at substantially the same elevation as the bottom of the track, a punch that is sized to fit into the cavities of the die, and means for moving the punch toward the die sufficiently to enter the cavities so as to deform the carrying strip into the die cavities and also away from the die sufficiently to enable the strip to move through the space between the die and punch.

6. A machine according to claim 5 in which the drive means advances the carrying strip incrementally along the path, there being a slight dwell between each advance, and the means for moving the punch moves it toward and away from the die during the dwell period.

7. A machine for packaging small solid objects between a carrying strip and a covering strip, at least one of which is coated with a sealant that is activated by heat, said machine comprising; means on the machine defining a path; drive means for advancing the carrying strip incrementally along the path and for also advancing the covering strip simultaneously with the carrying strip along a portion of the path, with the covering strip overlying the carrying strip along said portion of the path, the drive means including rollers which come together at a nip into which the covering and carrying strips pass in overlying relation, means for incrementally rotating the rollers to advance the strips including a spring and a displaceable chain connected to the spring such that the spring maintains the chain in tension, the chain being coupled to one of the rollers such that the chain will rotate that roller when the chain is displaced in the proper direction, and means for preventing the rollers from turning in the opposite direction, whereby the strips will only advance in one direction along the path; forming means along the path for creating upwardly opening pockets in the carrying strip; loading means along the path beyond the forming means and ahead of the portion of the path where the covering strip overlies the carrying strip for facilitating the loading of the small objects into the pockets of the carrying strip; sealing means along the portion of the path at which the covering strip overlies the carrying strip for sealing the covering strip to the carrying strip around the pockets in the carrying strip, the sealing means heating the strips sufficiently to activate the sealant and seal the two strips together in their areas surrounding the pockets; a camshaft having cams, one of which periodically displaces the chain of the drive means against the tension exerted by the spring so that the spring force is transmitted through the chain to said one cam of the camshaft where it is capable of exerting torque on the camshaft, the camshaft having another cam which operates the sealing means such that the sealing means forces the strips together during the dwell between incremental advances of the strips by the drive means; an electric motor positively coupled to the camshaft for turning the camshaft; and brake means on the motor for preventing rotation of the camshaft when the motor is de-energized, whereby any torque applied to the camshaft by the spring of the drive means will not rotate the camshaft when the motor is de-energized, so that the sealing means remains at all times perfectly synchronized with the pockets formed by the forming means.

8. A machine according to claim 7 wherein the forming means comprises a fixed forming die having an upwardly presented surface over which the carrying strip passes and a die cavity opening out of the surface, a punch which aligns with and is sized to fit into the cavity of the forming die, and operating means for moving the punch into and out of the cavity in the forming die such that when the punch is in the cavity it deforms a portion of the carrying strip into the general configuration of the punch and when out of the cavity it permits the carrying strip to advance incrementally between the forming die and the punch, the operating means being operated by one of cams on the camshaft such that it forces the punch into the cavity of the forming die during the dwell between incremental advances of the strip by the drive means.

9. A machine according to claim 8 wherein the camshaft is located below the path and the forming die, and the operating means for the punch of the forming means comprises a carrying plate to which the punch is attached, a post extending downwardly past the forming die on each side of the path, the posts being capable of moving upwardly and downwardly and at their upper ends being attached to the carrying plate, and a yoke connected to the lower ends of the posts, the yoke also being fitted around the cam of the camshaft which operates the operating means, whereby the cam moves the yoke, the posts, and the carrying plate upwardly and downwardly as the camshaft rotates.

10. A machine according to claim 7 wherein the sealing means comprises a fixed platen that is located immediately below the path and has at least one cavity that is sized to align with and receive the pockets in the carrying strip, means for heating the platen to a temperature sufficiently high to activate the sealant coating, a pressure plate located above the platen, and actuating means for moving the pressure plate toward the platen to compress the covering and carrying strips together between the platen and pressure plate, the actuating means also being adapted to move the pressure plate away from the platen sufficiently to enable the joined together strips to advance along the path.

11. A machine according to claim 10 wherein the camshaft is located below the platen of the sealing means and the actuating means for the sealing means comprises a cross plate extended over the pressure plate of the sealing means, and having the pressure plate suspended from it, springs between the cross and pressure plates for urging the pressure plate downwardly, a post extending downwardly past the platen on each side of the path, the posts being capable of moving upwardly and downwardly and at their upper ends being attached to the cross plate, and a yoke connected to the lower ends of the posts and also being extended around the cam of the camshaft which operate the actuating means, all such that the yoke, the posts, the cross plate, and the pressure plate reciprocate upwardly and downwardly as the camshaft revolves.

12. A machine according to claim 7 and further comprising printing means for printing information on the carrying strip, the printing means including a backing surface that is located along the path such that the carrying strip passes over it, a block pivoted with respect to the path and having an arm extended from it to the region of the camshaft where the arm bears against a cam on the camshaft, whereby the block will pivot backwardly and forwardly as the camshaft revolves, a stencil holder mounted on the block for supporting a stencil opposite the backing surface, the holder being positioned on the block such that it will move the stencil against the carrying strip when the camshaft rocks the pivot block forwardly, whereby information is printed on the carrying strip.

13. A machine according to claim 12 wherein the stencil holder is adjustable on the pivot block such that the location along the path at which the stencil marks the carrying strip can be altered.

14. A machine according to claim 7 and further comprising cutting means for severing individual packages from the joined together strips beyond the sealing means, with each package containing at least one pocket, the cutting means comprising: a fixed blade located along the path, a pivoted blade mounted along the fixed blade such that it is capable of pivoting across the path and wiping over an edge of the fixed blade, a bell crank located in the region of the camshaft such that it pivots with respect to the fixed blade, the bell crank having one of its arms against a cam on the camshaft so the camshaft pivots the bell crank, a tie rod connecting the other cam of the bell crank to the pivoted blade, all such that the cam moves the pivoted blade across the path during the dwell between incremental advances of the strips by the drive means.

15. A machine according to claim 14 wherein the pivoted blade has a serrated cutting edge, and further comprising means for altering the extent to which the pivoted blade moves past the cutting edge, said means in one condition permitting the serrations to pass completely by the cutting edge of the fixed blade so that the joined together strips are totally severed and in another condition enabling the serrated edge of the pivoted blade to pass only partially past the cutting edge of the fixed blade such that the joined together strips are only perforated.

16. A machine according to claim 15 wherein the means for altering the extent to which the pivoted blade moves past the edge of the fixed blade comprises an eccentric pivot pin connecting the tie rod to the pivoted blade.

17. A machine for packaging small solid objects between a carrying strip and a covering strip, at least one of which has on it a sealant that is activated by heat, said machine comprising: a housing; a camshaft mounted within the housing; an electric motor connected to the camshaft for rotating it incrementally; brake means for preventing the camshaft from turning when it is not driven by the motor; a drive mechanism for advancing the strips along the housing and including a pair of rollers mounted on the housing and forming a nip into which the carrying strip and the covering strip pass, with the covering strip being located over the carrying strip, and means operated by a cam on the camshaft for incrementally rotating at least one of the rollers in the direction which causes strips to advance along the housing, the drive mechanism also including means for preventing at least one of the rollers from turning in the direction opposite to that in which it turns when the strips advance so as to prevent the strips from moving in the opposite direction; a forming mechanism mounted on the housing ahead of the drive mechanism and in alignment with the carrying strip for imparting side-by-side pockets to the carrying strip in the intervals between incremental advances of the carrying strip, the forming mechanism including a die that is generally fixed in position on the housing and has side-by-side cavities and punches that align with the cavities, the forming mechanism also including means connecting the punches with a cam on the camshaft such that the cam both moves the punches into the die cavities to impart pockets to the carrying strip and withdraws them sufficiently from the cavities to enable the carrying strip with the pockets formed in it to pass between the die and punches as the carrying strip advances, whereby a succession of side-by-side pockets arranged in two rows are formed in the carrying strip; a loading device located on the housing between the drive mechanism and the forming mechanism and including a track that is mounted on the housing and is configured to support the carrying strip in a generally horizontal plane with the pockets opening upwardly, the track further being configured to permit the strip to advance when the rollers of the drive mechanism turn, the loading device also including a separate tray located along each lateral of the track at an elevation slightly higher than the carrying strip for supporting the small objects and a dividing rail mounted over the track and extended longitudinally with respect to the track such that it is generally between the two rows of pockets formed in the carrying strip so as to form a barrier for facilitating the displacement of small objects from either tray into the row of pockets that passes closest to that tray, the dividing rail, while being spaced from the track to permit the carrying strip to pass between the rail and the track, nevertheless being located close enough to the track to prevent the carrying strip from lifting significantly off of the track; means located after the track and before the drive mechanism for directing the covering strip over the carrying strip; a sealing mechanism mounted on the housing between the drive mechanism and the means for directing the covering strip onto the carrying strip, the sealing mechanism including a pair of surfaces, one of which is mounted in a fixed position with respect to the housing and the other of which is movable between a closed position wherein the surfaces compress the covering and carrying strips together in the regions surrounding the cavities in the carrying strip and an open position wherein the surfaces are spaced apart sufficiently to enable the two strips to advance through the space between them, the sealing mechanism also including a heating device for heating one of the surfaces to a temperature high enough to activate the sealant, the sealing mechanism further including means for connecting the movable surface with one of the cams on the camshaft such that the cam during the intervals between incremental advances of the strips moves the movable surface both into its closed position and into its open position; and a cutting unit mounted on the housing beyond the rollers for cutting the joined together carrying and covering strips transversely in the regions between successive side-by-side pockets, the cutting unit including a fixed blade mounted in a fixed position on the housing and a movable blade mounted to pivot about an axis that is fixed with respect to the housing so as to move between an open position wherein the joined together carrying and covering strips can pass between the blades and a closed position wherein the movable blade will pass across the fixed blade and cut the joined together strips transversely, the cutting unit also including means connecting the movable blade with a cam on the camshaft for causing the pivoted blade to move to its closed position in intervals between incremental advances imparted to the strips by the rollers.

18. A machine according to claim 17 wherein at least one of the blades of the cutting unit has serrations and the cutting unit further includes means for adjusting the extent to which the movable blade passes across the fixed blade such that in one position the movable blade will completely sever the joined together strips and in another position the serrations do not pass completely through the joined together strips so that the strips are left with perforations.

19. A machine according to claim 17 wherein the means connecting the movable blade of the cutting unit with its cam includes a bell crank mounted on the housing to pivot about an axis that is parallel to and fixed in position with respect to the axis of the camshaft, the bell crank having one leg which follows the cam for the cutting unit and another leg, and a tie rod connecting the other leg to the movable blade.

20. A machine according to claim 17 wherein one of the rollers of the drive mechanism carries a disk having teeth which as the rollers revolve puncture the joined together strips between the two rows of pockets in the carrying strip so as to form perforations in the strips.

* * * * *